US007716921B2

(12) United States Patent
Cheng

(10) Patent No.: US 7,716,921 B2
(45) Date of Patent: May 18, 2010

(54) EXHAUST PARTICULATE FILTER

(75) Inventor: Shi-Wai S. Cheng, Troy, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 4 days.

(21) Appl. No.: 11/335,222

(22) Filed: Jan. 19, 2006

(65) Prior Publication Data

US 2007/0044458 A1 Mar. 1, 2007

Related U.S. Application Data

(60) Provisional application No. 60/713,541, filed on Sep. 1, 2005.

(51) Int. Cl.
*F01N 3/00* (2006.01)

(52) U.S. Cl. ..... 60/295; 60/274; 60/297; 60/300; 60/311

(58) Field of Classification Search ..... 60/274, 60/295, 297, 300, 303, 311
See application file for complete search history.

(56) References Cited

U.S. PATENT DOCUMENTS 4,404,795 A * 9/1983 Oishi et al. ..... 60/274
4,426,320 A 1/1984 Ernest et al. ..... 502/313
4,519,820 A * 5/1985 Oyobe et al. ..... 55/284
4,887,427 A * 12/1989 Shinzawa et al. ..... 60/286
4,934,142 A * 6/1990 Hayashi et al. ..... 60/297
5,019,142 A * 5/1991 Waschkuttis ..... 55/429
5,067,320 A * 11/1991 Kanesaki ..... 60/297
5,212,948 A * 5/1993 Gillingham et al. ..... 60/288
5,357,755 A * 10/1994 Gillingham et al. ..... 60/288
6,823,660 B2 * 11/2004 Minami ..... 60/280
7,107,763 B2 * 9/2006 Suwabe et al. ..... 60/295
2005/0050870 A1 3/2005 Cheng ..... 55/523

FOREIGN PATENT DOCUMENTS

WO WO 01/96717 12/2001

OTHER PUBLICATIONS

International Search Report for PCT/US06/33987 filed Aug. 31, 2006 dated Mar. 21, 2007 and corresponding to the subject application.

* cited by examiner

*Primary Examiner*—Binh Q. Tran
(74) *Attorney, Agent, or Firm*—Cantor Colburn LLP

(57) ABSTRACT

A particulate filter for an exhaust system configured to receive an exhaust flow is disclosed. The filter includes a wall-flow filtration element having a first regeneration zone and a second regeneration zone, the first zone being downstream of the second zone, and a heat source disposed at the first regeneration zone. In response to demand for regeneration, the wall-filtration element regenerates according to a staged regeneration such that the first zone initiates regeneration ahead of the second zone, and each zone regenerates in the direction of the exhaust flow.

20 Claims, 5 Drawing Sheets

EXHAUST PARTICULATE FILTER

CROSS REFERENCE TO RELATED APPLICATIONS

This application claims the benefit of U.S. Provisional Application Ser. No. 60/713,541 filed Sep. 1, 2005, which is incorporated herein by reference in its entirety.

BACKGROUND OF THE INVENTION

The present disclosure relates generally to an exhaust system, and particularly to a particulate filter for a diesel exhaust system.

Automotive exhaust systems for diesel and other internal combustion engines typically include a filtration system that limits the mass of particulate matter emitted with the exhaust gases. In diesel engine systems, this matter typically includes carbonaceous matter (soot) and ash particles. Present filtering methods to trap the exhaust particulates focus on wall-flow filtration. Wall-flow filtration systems typically have a high filtration efficiency not only for exhaust particulates but also for ash particles. Catalyzed diesel particulate filters have been used extensively, where the catalyst is normally applied either to the front end of the diesel particulate filter or applied to the whole filter for the purpose of reducing the regeneration temperature. Catalytic or thermal arrangements within the exhaust system, which serve to effect regeneration of the filtration element, tend to create high temperatures within the filtration body, which tends to limit the choice of materials for the filtration body. In view of present particulate filter arrangements, it is desirable to have a more advanced particulate filter that can operate with effective filtration and improved regeneration.

SUMMARY OF THE INVENTION

An embodiment of the invention includes a particulate filter for an exhaust system configured to receive an exhaust flow. The filter includes a wall-flow filtration element having a first regeneration zone and a second regeneration zone, the first zone being downstream of the second zone, and a heat source disposed at the first regeneration zone. In response to demand for regeneration, the wall-filtration element regenerates according to a staged regeneration such that the first zone initiates regeneration ahead of the second zone, and each zone regenerates in the direction of the exhaust flow.

Another embodiment of the invention includes a method for regenerating a particulate filter for an exhaust system configured to receive an exhaust flow. The particulate filter includes a wall-flow filtration element having a first regeneration zone and a second regeneration zone, the first zone being downstream of the second zone, and a heat source disposed at the first regeneration zone. In response to demand for regeneration, the wall-filtration element is regenerated according to a staged regeneration such that the first zone initiates regeneration ahead of the second zone, and each zone regenerates in the direction of the exhaust flow.

BRIEF DESCRIPTION OF THE DRAWINGS

Referring to the exemplary drawings wherein like elements are numbered alike in the accompanying Figures.

DETAILED DESCRIPTION OF THE INVENTION

An embodiment of the invention provides a particulate filter for an exhaust system of an automotive diesel engine having improved regeneration features. While the embodiment described herein depicts an automotive diesel engine as an exemplary diesel powerplant using a particulate filter, it will be appreciated that the disclosed invention may also be applicable to other diesel powerplants that require the functionality of the particulate filter herein disclosed, such as a diesel powered generator for example. While the disclosed invention is well suited for filtering the combustion byproducts of a diesel engine, it may also be applicable for filtering combustion byproducts of a gasoline powered engine.

Figure 1:
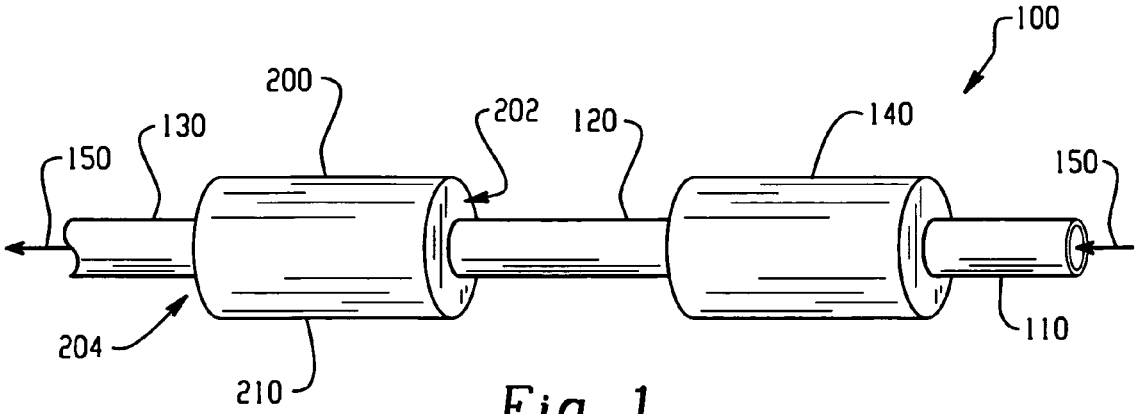
FIG. 1 depicts an exhaust system employing an embodiment of the invention.

An exemplary exhaust system 100 for an automotive diesel engine (not shown) is depicted in FIG. 1 having a manifold exhaust pipe 110 suitably connected at one end to an exhaust manifold (not shown) of the diesel engine (not shown) for receiving an exhaust flow depicted generally as numeral 150. Turbocharger 140 is suitably connected to intermediate manifold exhaust pipe 110 and intermediate exhaust pipe 120. Intermediate exhaust pipe 120 is suitably connected to a particulate filter 200 for trapping exhaust particulates present in the exhaust flow 150, which is suitably connected to an exhaust pipe 130. A tailpipe (not shown) for exhausting the conditioned exhaust flow to atmosphere is suitably connected to exhaust pipe 130. Exhaust system 100 manages the exhaust flow 150 by controlling how the exhaust flow 150 passes from exhaust manifolds (not shown) to manifold exhaust pipe 110, turbocharger 140, intermediate exhaust pipe 120, particulate filter 200, exhaust pipe 130, and then to atmosphere. Exhaust system 100 has a nominal flow area equal to or greater than the inside cross-sectional flow area of manifold exhaust pipe 110.

Figure 2:
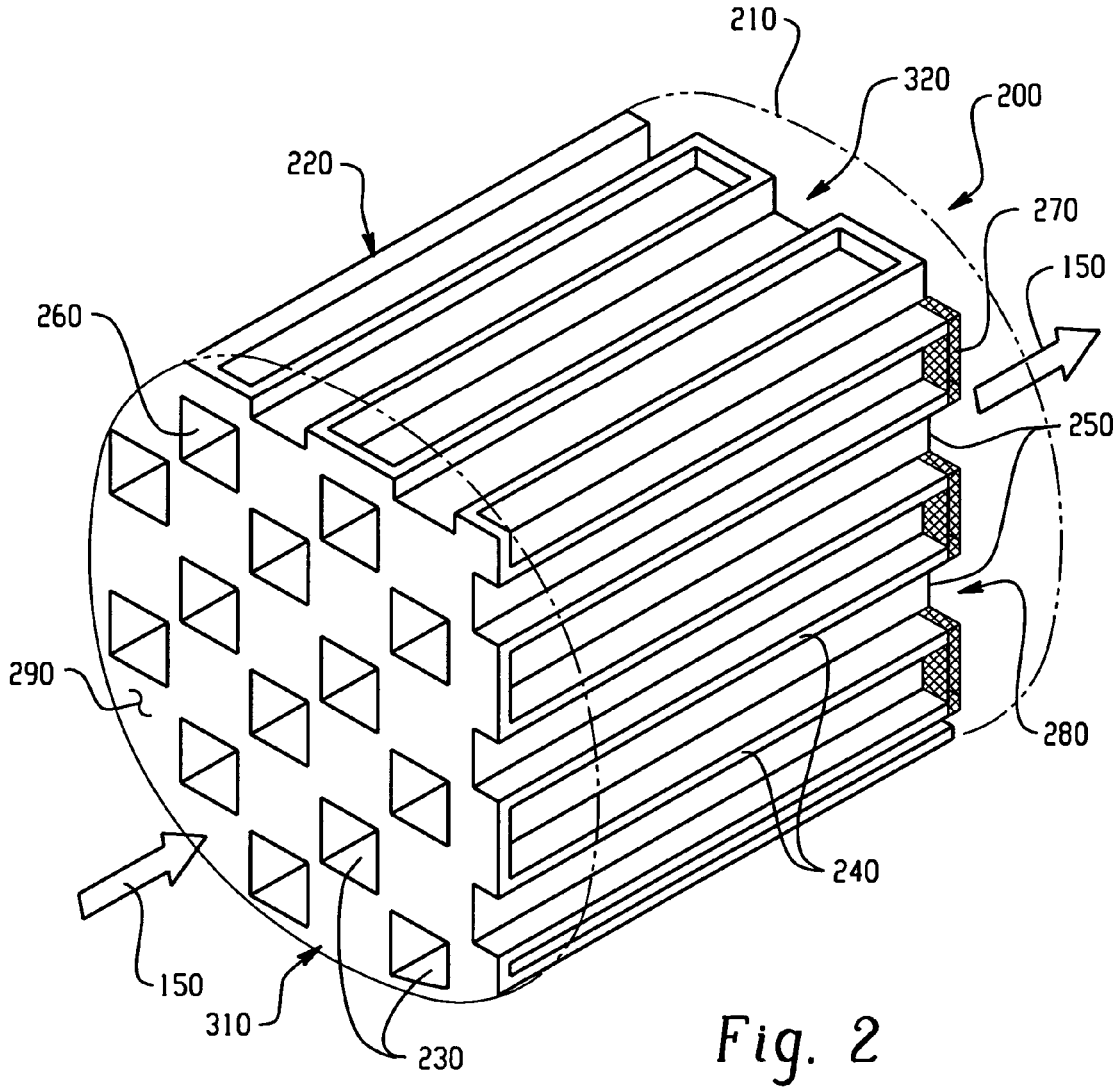
FIG. 2 depicts an isometric view of a particulate filter in accordance with an embodiment of the invention.

Each particulate filter 200 has a housing 210, which may be any form of construction and configuration suitable for the purpose, and a filter element 220 suitably contained within housing 210, best seen by now referring to FIG. 2. In an embodiment, filter element 220 is a ceramic monolith structure. Filter element 220 is of the wall-flow filtration type, meaning that exhaust flow 150 passes from the inlet channels 230, through the porous internal walls 240, to the outlet channels 250. Filtering of the exhaust flow 150 primarily occurs as exhaust flow 150 passes through the pores of internal walls 240, hence the term wall-flow filtration. Filter element 220 is configured to trap exhaust particulates.

In an exemplary embodiment, inlet channels 230 each have an inlet port 260 at one end 310 and a non-porous end-plug 270 at the opposite end 320. In an embodiment, the non-porous end-plugs 270 are substantially thicker (such as 0.25-0.5 inches for example) than the filter wall (such as 0.010-0.020 inches for example). In an alternative embodiment, non-porous end-plug 270 may be replaced by a porous end-plug 270'. End-plug 270 is also herein referred to as a standard end-plug for purposes of distinction. Embodiments of the invention may be applied to a particulate filter 200 having either a standard end-plug 270 or a porous end-plug 270'. In the various drawings, reference numeral 270 may be replaced with reference numeral 270' when reference is made to a porous end-plug. Outlet channels 250 each have an outlet port 280 at one end 320 and an end-plug 290 at the opposite end 310. Exhaust flow 150 enters filter element 220 at inlet ports 260, passes through porous internal walls 240, and is discharged from filter element 220 at outlet ports 280. In this manner, inlet channels 230 and outlet channels 250 are referred to as being in fluid communication with each other via internal walls 240. Internal walls 240 of filter element 220 are fabricated with a pore size less than about 30 micrometers, thereby enabling the entrapment of exhaust particulates. In an embodiment, porous end plugs 270 have a pore sized equal to or greater than about 30 micrometers, and equal to or less than about 60 micrometers. End-plugs 290 may be solid or may have a porosity similar to that of internal walls 240. In this manner, the artisan will readily recognize that in general, porous end-plugs 270 have a greater porosity than end-plugs 290.

Figure 3:
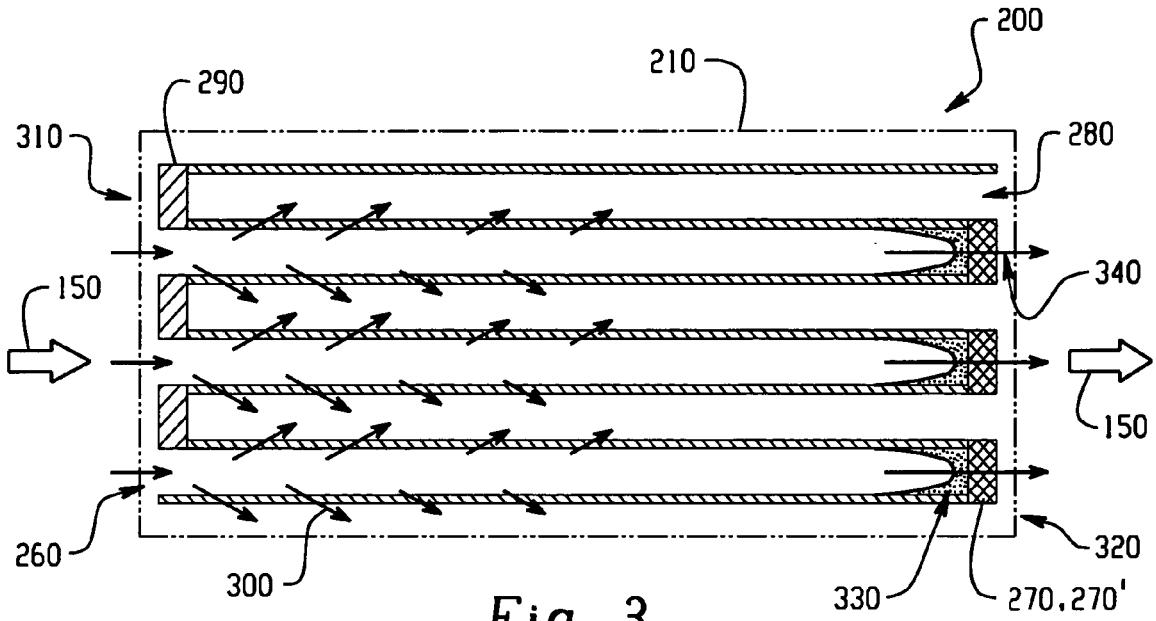
FIG. 3 depicts a cross section view of a particulate filter similar to that of FIG. 2 and in accordance with an embodiment of the invention.

In an embodiment depicted in FIG. 2, filter element 220 is a ceramic monolith structure having a plurality of porous internal walls 240 that define and separate the inlet and outlet channels 230, 250. Inlet and outlet channels 230, 250 are arranged parallel to the direction of exhaust flow 150, resulting in a sideways flow (depicted generally by arrows 300 in FIG. 3) as exhaust flow 150 passes through internal walls 240. Housing 210 includes a first end 310 and a second end 320. Inlet ports 260 and end-plugs 290 are arranged at first end 310, and outlet ports 280 and porous end-plugs 270 are arranged at second end 320. In an embodiment, and as depicted illustratively in FIGS. 2 and 3, the overall surface area of porous end-plugs 270 is substantially less than the total surface area of internal walls 240, with an exemplary ratio being less than about 1:240.

Outlet channels 250 have outlet ports 280 at second end 320 to discharge exhaust flow 150 and end-plugs 290 at first end 310 to block the incoming exhaust flow 150. Exhaust flow 150 is filtered at the ceramic monolith structure 220 as it passes through the porous walls 240 between inlet and outlet channels 230, 250. Exhaust byproducts, such as metallic particles and carbonaceous matter, are trapped at porous walls 240, end-plugs 290, and porous end-plugs 270. The filtered exhaust flow 150 is then discharged at outlet ports 280.

As discussed above, porous end-plugs 270 may be replaced with standard end-plugs 270', and unless otherwise specified the discussion that follows applies to both.

A diesel particulate filter (dpf), such as the particulate filter 200 and more particularly filter element 220, requires regeneration from time to time. Normally regeneration is initiated by increasing the inlet temperature of the exhaust gases at first end 310 to a temperature higher than 650° C. At this temperature, soot deposited on the filter walls 240 will react with the oxygen in the exhaust gases and will be converted into CO and $CO_2$. This reaction is strongly exothermic. The reaction and the associated heat will propagate toward the downstream side of the filter to second end 320, which causes high temperature near the second end 320 of the filter. As the soot deposited at the first end 310 of the filter is oxidized, some of the exhaust gases will flow through the filter wall 240 and flow out the filter through the exit channels (outlet channels) 250. Consequently, less flow will pass through the yet to be regenerated part of the inlet channels 230.

Figure 4:
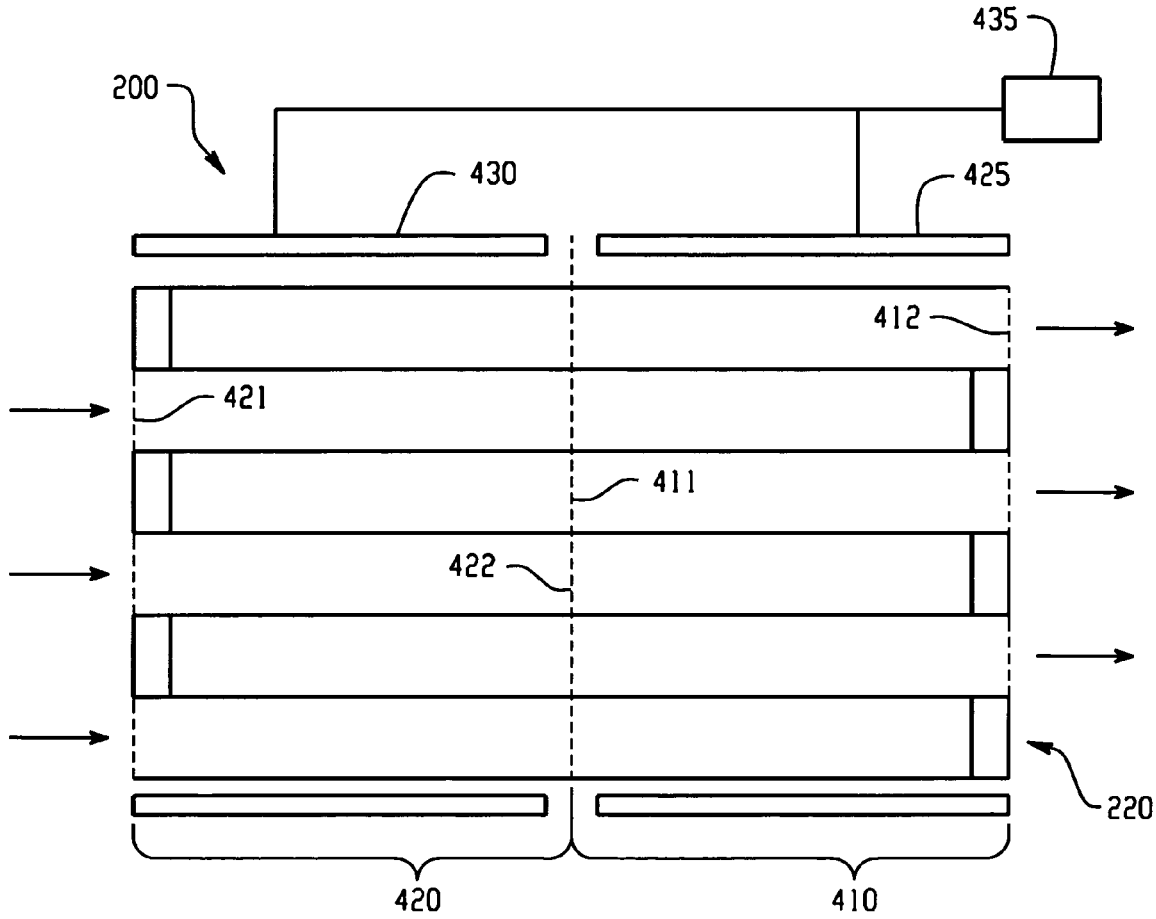
FIG. 4 depicts in schematic view an embodiment of a particulate filter in accordance with and embodiment of the invention.

To improve upon the regeneration of particulate filter 200, an embodiment of the invention provides for staged regeneration, that is, the length of particulate filter 200, from first end 310 to second end 320, is arranged into zones, such as first zone 410 and second zone 420 for example, best seen by referring to FIG. 4, with regeneration occurring in first zone 410 and then in second zone 420. While an embodiment of the invention is depicted and described herein having only two zones, it will be appreciated that any number of zones may be applied in accordance with embodiments of the invention, and that the scope of the invention is not limited to only the two-zone arrangement depicted and described herein.

Each zone 410, 420 has a front end 411, 421 and a back end 412, 422, respectively. In response to a demand for regeneration, the downstream first zone 410 is caused to regenerate first, beginning at its front end 411 and progressing with the flow to its back end 412, and then the upstream second zone 420 is caused to regenerate second, beginning at its front end 421 and progressing with the flow to its back end 422. With the regeneration progressing from downstream first zone 410 (front to back) then to upstream second zone 420 (front to back), the regeneration of particulate filter 200 is said to be staged.

From the foregoing, it will be appreciated that no matter how many regeneration zones there are in particulate filter 200, the staged regeneration is caused to take place beginning at the downstream zone with progression toward the upstream zone, with each zone regenerating from front to back in the direction of the flow.

The regeneration of each zone may be caused by heaters 425, 430 or activation of a catalyst 405, which will be discussed in more detail below.

While FIG. 4 is depicted having heating elements 425, 430 along the entire length of first and second zones 410, 420, respectively, it will be appreciated that only the first zone 410 may have a heater 425, and that heater 425 may only be disposed proximate the front end 411 of first zone 410, since the generated heat will naturally flow in the direction of the exhaust flow toward the rear end 412 of first zone 410. In an alternative embodiment, a similar arrangement may also be applied for the second zone 420.

Figure 5A:
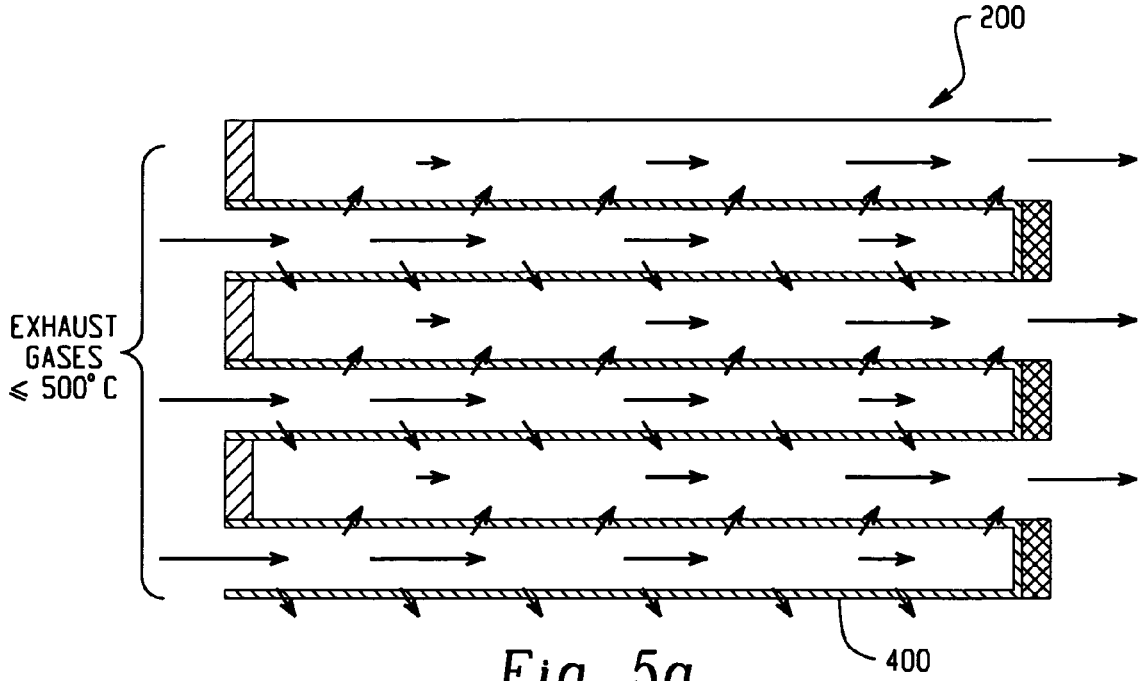
FIGS. 5*a*-5*b*, 6*a*-6*b*, and 7, depict alternative cross section views of a particulate filter similar to that of FIG. 2 under varying operating conditions and in accordance with an embodiment of the invention.
Figure 5B:
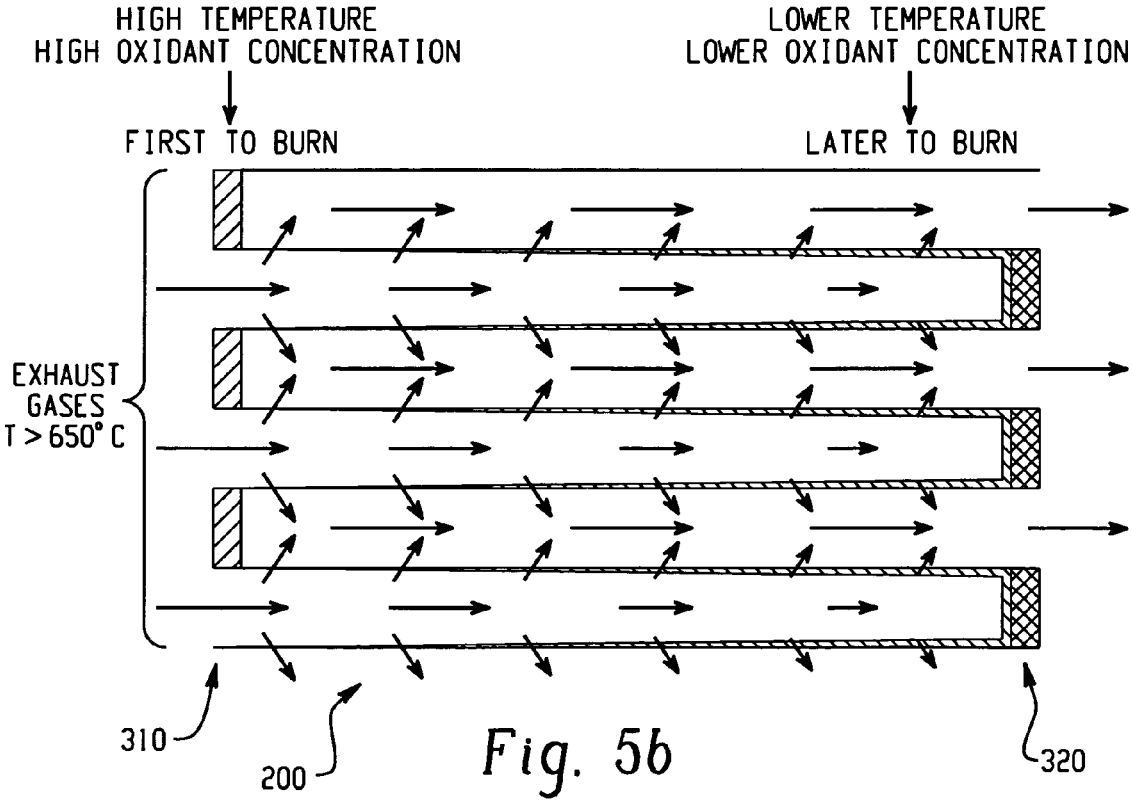

Reference is now made to FIGS. 5*a* and 5*b*, which depict a conventional dpf regeneration. FIG. 5*a* illustrates uniform accumulation of soot 400 on filter walls 240 with an inlet exhaust gas temperature of less than about 500° C. FIG. 5*b* illustrates the initiation of regeneration at the first end 310 of the dpf 220, where the inlet exhaust gas temperature has been elevated to greater than about 650° C. Here, the exhaust temperature may be raised by introducing some fuel into the exhaust system, or an oxidation catalyst upstream from the dpf may be used to oxidize the fuel and increase the exhaust temperature, or the exhaust temperature may be raised by an electrical heater located upstream from the dpf. In FIG. 5*b*, dpf 220 experiences a high temperature and a high oxidant concentration at the first end 310, and a respectively lower temperature and lower oxidant concentration at the second end 320. Consequently, and with reference still to FIG. 5*b*, the soot 400 at first end 310 would burn, without the assistance of an embodiment of the invention, before the soot 400 at second end 320. This in turn causes the exhaust flow through walls 240 from inlet channels 230 to outlet channels 250 to be concentrated toward the first end 310 of dpf 220, causing a lower flow rate through walls 240 toward the second end 320. As a consequence, the lower flow rate reduces the capacity for the exhaust gases to carry away the heat generated by oxidation of the soot 400. This situation may result in thermal run away for the soot deposits near the closed end (second end 320) of the inlet channels 230, which may lead to the filter degradation (melting or cracking of the filter).

Figure 6A:
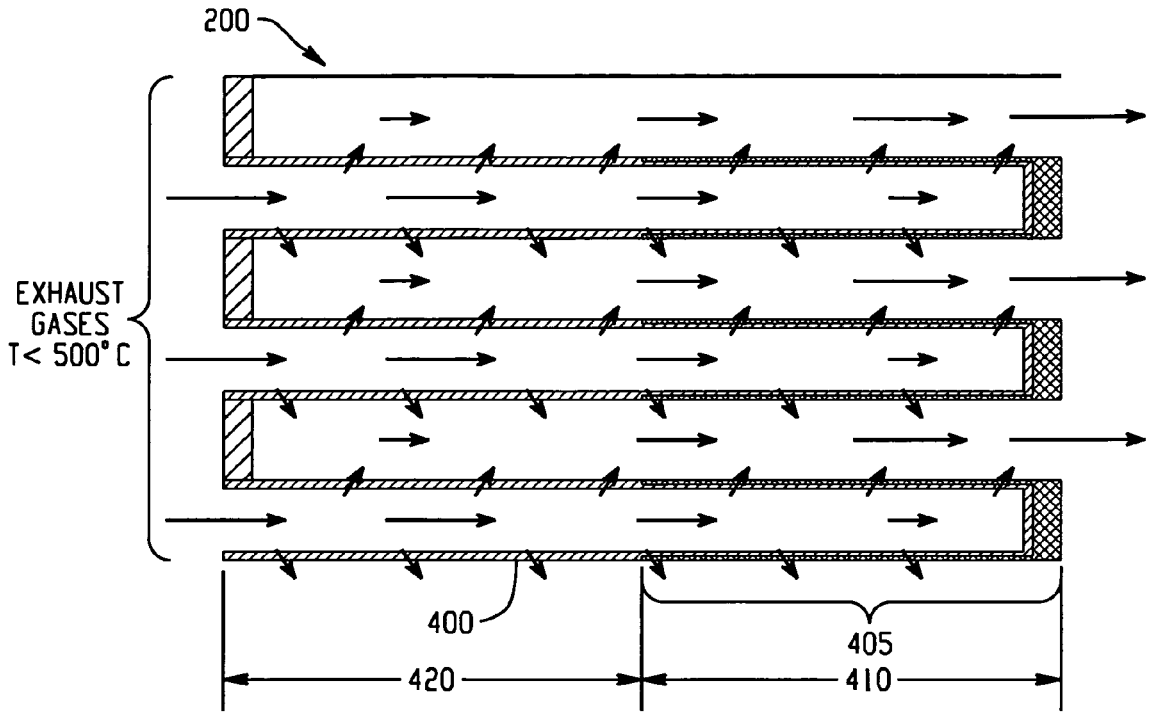

To avoid a thermal run away condition and protect the integrity of the diesel particulate filter 200, an embodiment of the invention includes a catalyzed filter element 220 having an oxidation catalyst 405 disposed at the last 25-50% of the filter element 220 (first zone 410). While embodiments are disclosed herein having an oxidation catalyst disposed over a defined percentage of the filter element length, it will be appreciated that this is for illustration purposes only, and that other embodiments may have a different percentage of catalyst coverage. FIG. 6*a* illustrates a zone-coated catalyzed filter 220 having an oxidation catalyst 405 disposed at first zone 410 on about the last 25% of the internal walls 240 toward the second end 320. Since the catalyst 405 can lower the ignition temperature of the soot deposits 400, the soot-oxygen reaction can be initiated proximate the back end (second end 320) of the filter 220 first, which will serve to remove the soot 400 deposited near the closed end (second end 320) of the inlet channel 230 first. More specifically, and as discussed previously, regeneration of filter element 220 at first zone 410 takes place in a direction with the flow from front end 411 toward back end 412 of first zone 410 (see also FIG. 4 depicting reference numerals 411 and 412). As a consequence, more exhaust gases will flow along the inlet channels 230 before they cross the internal walls 240 to the outlet channels 250. The resulting higher flow rate down the inlet channels 230 allows better heat transfer through convection, and thus, serves to lower the peak temperature and the associated thermal stress on the filter element 220 during filter regeneration. Furthermore, by the time the first end 310 is ignited, that is, the second zone 420 being elevated above the temperature of about 650° C., there is little or no soot 400 remaining at the first zone 410 near the closed end (second end) 320 of filter element 220. When the thermal energy associated with regeneration propagates to the closed end (second end) 320, there is little or no additional energy to be released on the closed end, which is where the temperature is normally the highest with a conventional regeneration method.

Figure 6B:
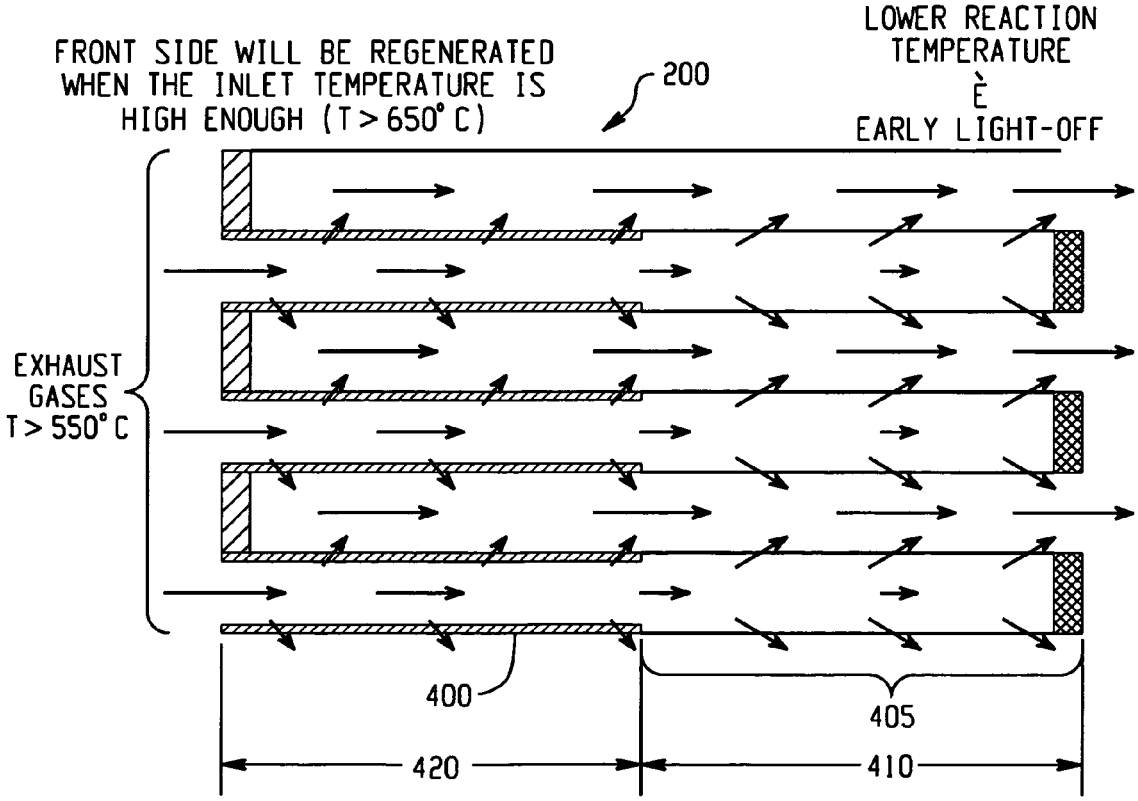

FIG. 6*b* illustrates the dpf 200 of FIG. 6*a*, but with an inlet exhaust temperature of about 550° C. or greater. With the catalyst 405 at the first zone 410 proximate the second end 320 effectively lowering the ignition temperature of the soot 400 by about 100° C. from about 650° C. to about 550° C., ignition of the soot 400 occurs first at the first zone 410. The second zone 420 is regenerated when the inlet exhaust temperature reaches or exceeds about 650° C.

Figure 7:
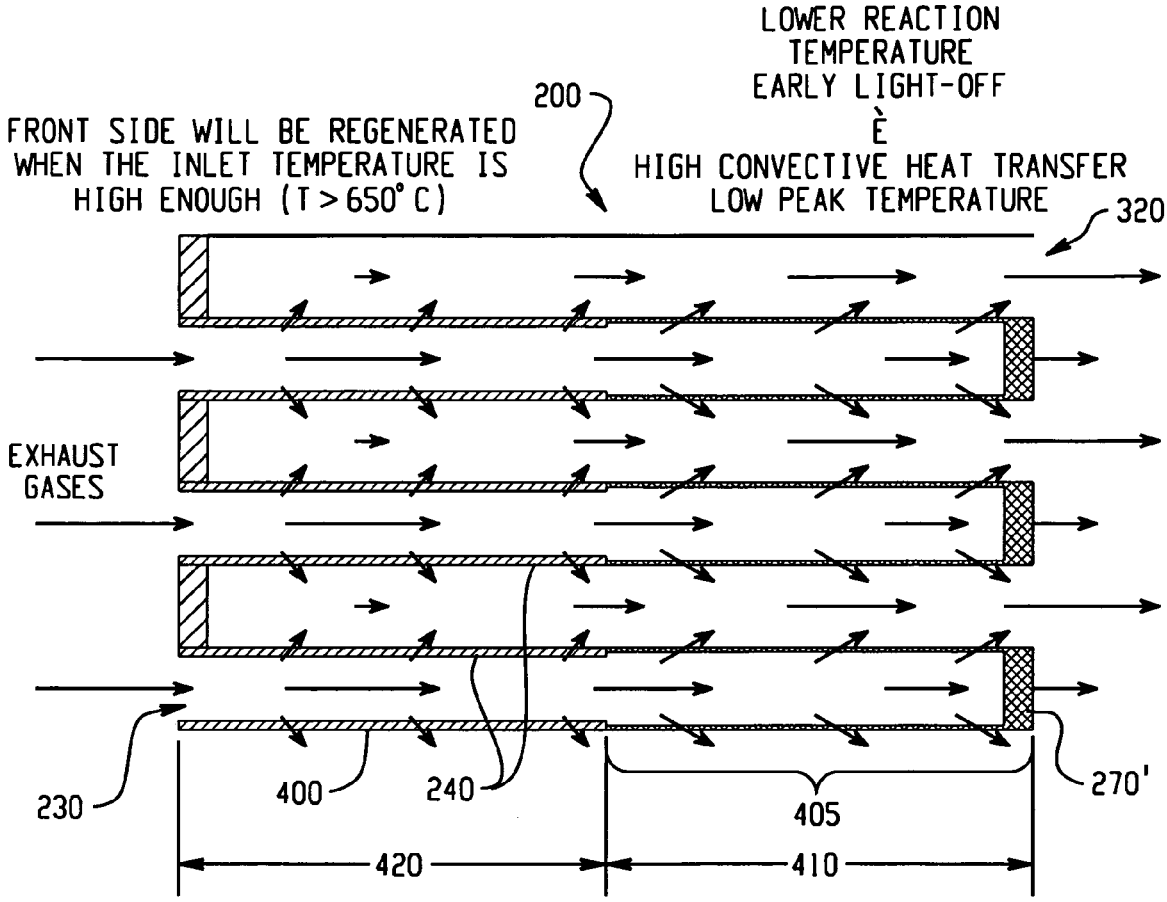

As previously discussed, embodiments of the invention may employ standard end-plugs 270 or porous end-plug 270'. FIG. 7 illustrates the dpf 200 with porous end-plugs 270' and a catalyst 405 disposed over the last 25-50% of the internal walls 240 toward the second end 320. The porous end-plugs 270' allow more flow to pass through the inlet channels 230 to the closed end, thereby further lowering the peak temperature near the closed end (second end) 320.

As previously discussed, regeneration at first and second zones 410, 420 may be initiated by auxiliary heaters 425, 430, rather than by a catalyst 405, which may be controlled by a control system 435 for providing controlled heating (best seen by referring to FIG. 4). In another embodiment, a combination of heaters and a catalyst may be employed. Heaters 425, 430 may be electric heaters, microwave heaters, or any heating device suitable for the purposes disclosed herein. Collectively, heaters 425, 430, catalyst 405, or other means of heating, such as activated soot for example, are herein referred to as heat sources.

When used as herein disclosed, filter element 220 may be made from Cordierite ($Mg_2Al_4Si_5O_{18}$, Magnesium Aluminum Silicate) or SiC (Silicon Carbide), which are two ceramic materials that may be used for manufacturing ceramic dpfs. Regarding Cordierite with forced regeneration, however, the peak temperature of conventional regeneration may be too high for the Cordierite dpf, which may cause it to either crack or melt. Consequently, this characteristic tends to dissuade the use of Cordierite for dpf's despite its low cost. Only from the teachings disclosed herein does the unexpected advantage arising from embodiments of the invention provide for the use of a Cordiertie dpf.

In view of the foregoing, some embodiments of the invention may include some of the following advantages: reduced peak temperature and therefore reduced thermal stress of the particulate filter 200 through staged regeneration that regenerates the filter beginning at a downstream zone and proceeding to an upstream zone; employing staged regeneration from a downstream zone to an upstream zone allows for regeneration in a direction of the exhaust flow, which is the natural direction of heat flow; less heat accumulation at the rear (exhaust) end of the filter; lowered peak regeneration temperature thereby allowing less frequent regeneration of particulate filter 200; the potential for providing a more durable diesel particulate filter (dpf); and, the option of using a Cordierite dpf which is much cheaper and weaker, but suitable for the intended purpose disclosed herein using staged regeneration, than the a SiC dpf.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A particulate filter for an exhaust system configured to receive an exhaust flow, comprising:

a wall-flow filtration particulate filter element having a first regeneration zone and a second regeneration zone, the first zone being downstream of the second zone, the first and second regeneration zones being part of the same wall-filtration particulate filter element; and a heat source disposed at the first regeneration zone;

wherein in response to demand for regeneration, the wall-filtration element regenerates according to a staged regeneration such that the first zone initiates regeneration ahead of the second zone, and each zone regenerates in the direction of the exhaust flow.

2. The particulate filter of claim 1, wherein:

the heat source comprises a catalyst.

3. The particulate filter of claim 1, wherein:

the heat source comprises a heater.

4. The particulate filter of claim 3, wherein:

the heater is an electric heater.

5. The particulate filter of claim 1, further comprising:

a second heat source disposed at the second regeneration zone.

6. The particulate filter of claim 1, further comprising:

a control configured to initiate heating at the heat source.

7. The particulate filter of claim 1, wherein the wall-flow filtration element comprises:

a first end, a second end, and internal walls having pores defining a porosity sufficient to trap carbonaceous exhaust particulates; and an inlet channel with an inlet port at the first end and a first end-plug at the second end, and an outlet channel with a second end-plug at the first end and an outlet port at the second end, the inlet channel being in fluid communication with the outlet channel via the internal walls;

wherein the internal walls define a first zone extending from the second end toward the first end a distance of about 25% to about 50% of the overall distance, and a second zone extending the remaining distance of about 50% to about 75% of the overall distance; and wherein an oxidation catalyst is disposed on the internal walls of the first zone.

8. The particulate filter of claim 7, wherein the oxidation catalyst is disposed on the internal walls of the first zone but not the second zone.

9. The particulate filter of claim 7, wherein the oxidation catalyst comprises Cordierite.

10. The particulate filter of claim 7, wherein:

the porosity of the first end-plug is greater than the porosity of the second end-plug.

11. A method for regenerating a particulate filter for an exhaust system configured to receive an exhaust flow, the particulate filter comprising a wall-flow filtration particulate filter element having a first regeneration zone and a second regeneration zone, the first zone being downstream of the second zone, the first and second regeneration zones being part of the same wall-filtration particulate filter element, the wall-flow filtration particulate filter element of the first zone being continuous with the wall-flow filtration particulate filter element of the second zone without interruption, and a heat source disposed at the first regeneration zone, the method comprising:

in response to demand for regeneration, regenerating the wall-filtration element according to a staged regeneration such that the first zone initiates regeneration ahead of the second zone, each zone regenerates in the direction of the exhaust flow, and the regeneration progresses along the continuous particulate filter element defined by the wall-flow filtration particulate filter element of the first zone being continuous with the wall-flow filtration particulate filter element of the second zone.

12. The method of claim 11, wherein:

the regeneration of the first zone comprises igniting deposited soot via an oxidation catalyst disposed at the first zone.

13. The method of claim 12, wherein:

the regeneration of the second zone comprises igniting deposited soot in the absence of an oxidation catalyst disposed at the second zone.

14. The method of claim 11, wherein:

the regeneration of the first zone comprises igniting deposited soot via a heater disposed proximate the first zone.

15. The method of claim 14, wherein:

the regeneration of the second zone comprises igniting deposited soot via a heater disposed proximate the second zone.

16. The particulate filter of claim 1, wherein:

the heat source is disposed at least partially along a length of the first regeneration zone.

17. The particulate filter of claim 5, wherein;

the second heat source is disposed at least partially along a length of the second regeneration zone.

18. The particulate filter of claim 1, wherein:

the wall-flow filtration element of both the first regeneration zone and the second regeneration zone is a particulate filter.

19. The particulate filter of claim 1, wherein:

the wall-flow filtration particulate filter element of first zone is continuous with the wall-flow filtration particulate filter element of the second zone without interruption.

20. A method for regenerating a particulate filter for an exhaust system configured to receive an exhaust flow, the particulate filter comprising a wall-flow filtration element having a first regeneration zone and a second regeneration zone, the first zone being downstream of the second zone, and a heat source disposed at the first regeneration zone, the wall-flow filtration element further comprising a first end, a second end, and internal walls having pores defining a porosity sufficient to trap carbonaceous exhaust particulates, and an inlet channel with an inlet port at the first end and a first end-plug at the second end, and an outlet channel with a second end-plug at the first end and an outlet port at the second end, the inlet channel being in fluid communication with the outlet channel via the internal walls, wherein the internal walls define a first zone extending from the second end toward the first end a distance of about 25% to about 50% of the overall distance, and a second zone extending the remaining distance of about 50% to about 75% of the overall distance, and wherein an oxidation catalyst is disposed on the internal walls of the first zone, the method comprising:

in response to demand for regeneration, regenerating the wall-filtration element according to a staged regeneration such that the first zone extending the distance of about 25% to about 50% of the overall distance initiates regeneration ahead of the second zone extending the remaining distance of about 50% to about 75% of the overall distance, and each zone regenerates in the direction of the exhaust flow.

* * * * *